US006217674B1

(12) United States Patent
Gray et al.

(10) Patent No.: US 6,217,674 B1
(45) **Date of Patent: *Apr. 17, 2001**

(54) COMPOSITIONS AND PROCESS FOR TREATING METAL SUBSTRATES

(75) Inventors: Ralph C. Gray, Butler; Brian T. Hauser, Murrysville; Joseph T. Valko, Pittsburgh, all of PA (US)

(73) Assignee: PPG Industries Ohio, Inc., Cleveland, OH (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/309,849

(22) Filed: May 11, 1999

(51) Int. Cl.[7] ..... C23C 22/48

(52) U.S. Cl. ..... 148/247; 148/251; 427/410; 427/419.5; 405/14.15; 405/14.37

(58) Field of Search ..... 148/247, 251, 148/274; 427/410, 419.5, 333; 106/14.15, 14.37

(56) References Cited

U.S. PATENT DOCUMENTS

| | | | | |
|---|---|---|---|---|
| 3,912,548 | | 10/1975 | Faigen | 148/6.15 R |
| 3,966,502 | | 6/1976 | Binns | 148/6 |
| 4,132,572 | | 1/1979 | Parant et al. | 148/6.15 R |
| 4,865,704 | * | 9/1989 | Saatweber et al. | 204/181.7 |
| 5,129,967 | | 7/1992 | Sander et al. | 148/247 |
| 5,209,788 | | 5/1993 | McMillen et al. | 148/247 |
| 5,328,525 | | 7/1994 | Musingo et al. | 148/247 |
| 5,342,456 | | 8/1994 | Dolan | 148/247 |
| 5,344,504 | | 9/1994 | Deck et al. | 148/243 |
| 5,449,415 | | 9/1995 | Dolan | 148/259 |
| 5,534,082 | * | 7/1996 | Dollman | 148/247 |
| 5,584,946 | | 12/1996 | Karmaschek et al. | 148/247 |
| 5,653,823 | | 8/1997 | McMillen et al. | 148/247 |
| 5,662,746 | | 9/1997 | Affinito | 148/247 |
| 5,801,217 | | 9/1998 | Rodzewich et al. | 523/409 |
| 5,804,652 | | 9/1998 | Jones et al. | 525/56 |

FOREIGN PATENT DOCUMENTS

| | | |
|---|---|---|
| 2087352 | 1/1994 | (CA) . |
| 61911 | 10/1982 | (EP) . |
| 57-192741 | 4/1991 | (JP) . |
| WO95/33869 | 12/1995 | (WO) . |
| WO96/27034 | 9/1996 | (WO) . |
| WO97/14822 | 4/1997 | (WO) . |
| 94/5750 | 8/1994 | (ZA) . |

* cited by examiner

*Primary Examiner*—John Sheehan
*Assistant Examiner*—Andrew L. Oltmans
(74) *Attorney, Agent, or Firm*—William J. Uhl

(57) ABSTRACT

A composition for passivating a metal substrate is provided. The composition is prepared by mixing together:

a) Group IIIB or IVB metal compound; and b) a reaction product of an epoxy group-containing polymer or oligomer, a hydroxy functional acid and a dialkanolamine. The compositions, which are substantially free of chrome, are used to treat metal substrates prior to the application of a protective or decorative coating.

29 Claims, No Drawings

COMPOSITIONS AND PROCESS FOR TREATING METAL SUBSTRATES

BACKGROUND OF THE INVENTION

The present invention relates to passivating compositions and a process for treating metal substrates prior to the application of a decorative or protective coating.

Passivating metal substrates with a phosphate conversion coating and chrome-containing rinse, prior to the application of a protective or decorative coating, is well known for promoting corrosion resistance. Phosphate conversion coating compositions typically contain heavy metals such as nickel and post-rinses contain chrome, producing waste streams that pose environmental concerns and which are expensive to dispose.

Rinsing compositions utilizing metal ions other than chromium are also known in the art and are disclosed, for example, in U.S. Pat. Nos. 3,966,502 and 4,132,572. U.S. Pat. No. 3,966,502 discloses treatment of phosphated metals with zirconium-containing rinse solutions. Other rinse compositions containing combinations of Group IVB metal ions with polymeric materials have also been used over phosphated substrates. See, for example, U.S. Pat. Nos. 3,912,548, 5,209,788, and 5,653,823. However, many post-rinse compositions are suitable for use over a limited number of substrates or over substrates that must be phosphated first.

It would be desirable to provide a composition for passivating metal substrates prior to the application of a protective or decorative coating which is substantially free of chrome. Preferably the composition would be effective in passivating a number of metal substrates, particularly metallic objects fashioned with more than one substrate type, such as are commonly found on automobile bodies, so that the need to perform separate passivating treatments would be eliminated. More preferably, the compositions would additionally be effective in passivating untreated (i.e. non-phosphated) metal substrates.

SUMMARY OF THE INVENTION

In accordance with the present invention, a composition for passivating a metal substrate is provided. The composition is prepared by mixing together, usually in a carrier medium:

a) a Group IIIB or IVB metal compound; and b) a reaction product of an epoxy group-containing polymer or oligomer such as a polyglycidyl ether of a polyphenol, a hydroxy acid such as dimethylolpropionic acid and a dialkanolamine such as diethanolamine.

Also provided is a process for treating a metal substrate by contacting the substrate with the composition. The process may further include subsequent steps of coating the substrate with any of a number of protective or decorative film-forming compositions, including coatings applied by electrodeposition, primers applied by non-electrophoretic means, and powder coating compositions.

DETAILED DESCRIPTION

Other than in the operating examples, or where otherwise indicated, all numbers expressing quantities of ingredients or reaction conditions used in the specification and claims are to be understood as modified in all instances by the term "about". The composition and process of the present invention are typically used to passivate metal substrates such as cold rolled steel, steel coated with zinc metal, zinc compounds or zinc alloys such as electrogalvanized steel, hot-dipped galvanized steel, galvanealed steel, and steel plated with zinc alloy. Also, aluminum alloys, aluminum plated steel and aluminum alloy plated steel substrates may be used. Preferably, the substrate is a multimetal substrate containing two or more metals such as cold rolled steel; steel coated or plated with zinc metal, zinc compounds or zinc alloys and aluminum. By passivation is meant the process of applying a treatment to a metal substrate which improves its corrosion resistance compared to its resistance without such a treatment.

The substrate is usually first cleaned to remove grease, dirt, or other extraneous matter. This is done by employing conventional cleaning procedures and materials. These would include mild or strong alkaline cleaners such as are commercially available and conventionally used in metal pretreatment processes. Examples of alkaline cleaners include Chemkleen 163 and Chemkleen 177, both of which are available from PPG Industries, Pretreatment and Specialty Products. Such cleaners are generally followed and/or preceded by a water rinse(s).

Optionally, the metal surface may be rinsed with an aqueous acidic solution after cleaning with the alkaline cleaner and before contact with the composition. Examples of rinse solutions include mild or strong acidic cleaners such as the dilute nitric acid solutions commercially available and conventionally used in metal pretreatment processes.

The metal substrate may also optionally be phosphated. Suitable phosphate conversion coating compositions may be any of those known in the art. Examples include zinc phosphate, iron phosphate, manganese phosphate, calcium phosphate, magnesium phosphate, cobalt phosphate, zinc-iron phosphate, zinc-manganese phosphate, zinc-calcium phosphate, and layers of other types, which may contain one or more multi-valent cations. Phosphating compositions are known to those skilled in the art and are described in U.S. Pat. Nos. 4,941,930, 5,238,506, and 5,653,790.

Following the optional cleaning and phosphating steps, the metal surface is contacted with the composition of the present invention.

The composition of the present invention is typically dispersed or dissolved in a carrier medium, usually an aqueous medium. The solution or dispersion may be applied to the metal substrate by known application techniques, such as dipping or immersion, which is preferred, spraying, intermittent spraying, dipping followed by spraying, spraying followed by dipping, brushing, or by roll-coating. Typically, the solution or dispersion when applied to the metal substrate is at a temperature ranging from 60 to 150° F. (15 to 65° C.). The contact time is generally between 10 seconds and five minutes, preferably 30 seconds to 2 minutes.

The Group IIIB or IVB metals referred to herein are those elements included in such groups in the CAS Periodic Table of the Elements as is shown, for example, in the *Handbook of Chemistry and Physics,* 63rd Edition (1983). Where applicable, the metals themselves, but more usually metal compounds are used.

Preferred Group IIIB and IVB metal compounds are compounds of zirconium, titanium, hafnium, yttrium and cerium and mixtures thereof. Typical zirconium compounds may be selected from hexafluorozirconic acid, alkali metal and ammonium salts thereof, ammonium zirconium carbonate, zirconyl nitrate, zirconium carboxylates and zirconium hydroxy carboxylates such as hydrofluorozirconic acid, zirconium acetate, zirconium oxalate, ammonium zirconium glycolate, ammonium zirconium lactate, ammonium zirconium citrate, and mixtures thereof. Hexafluorozirconic acid is preferred. An example of the yttrium compound is yttrium nitrate. An example of the titanium compound is fluorotitanic acid and its salts. An example of the hafnium compound is hafnium nitrate. An example of the cerium compound is cerous nitrate. The Group IIIB or IVB metal compound is typically present in the carrier medium in an amount of 10 to 5000 ppm metal, preferably 100 to 1000 ppm metal based on total weight of the composition. The pH of the medium is usually from 2.0 to 7.0, preferably 2.7 to 6.5. The pH of the medium may be adjusted using mineral acids such as hydrofluoric acid, fluoroboric acid, phosphoric acid, and the like, including mixtures thereof; organic acids such as lactic acid, acetic acid, citric acid, sulfamic acid, or mixtures thereof; and water soluble or water dispersible bases such as sodium hydroxide, ammonium hydroxide, ammonia, or amines such as triethylamine, methylethyl amine, or mixtures thereof.

The composition also contains the reaction product of an epoxy-containing polymer or oligomer (polyepoxide) with a dialkanolamine and a hydroxy acid. Examples of suitable epoxy-containing polymers or oligomers include polyglycidyl ethers of polyhydric phenols such as the polyglycidyl ether of Bisphenol A. The preferred polyglycidyl ether is the diglycidyl ether of Bisphenol A.

Examples of dialkanolamines include those which contain up to four carbon atoms such as diisopropanolamine, diethanolamine, di(2-hydroxybutyl)amine, and N-(3-hydroxypropyl) ethanolamine. Diethanolamine is preferred.

Examples of hydroxy acids include dimethylolpropionic acid, which is preferred, trimethylolpropionic acid, pentaerythritol, malic acid, lactic acid, glycolic acid, gluconic acid, glucuronic acid, citric acid, 3-hydroxypivalic acid, and salicylic acid.

The reaction product may be prepared as follows: the epoxy-containing polymer or oligomer is added to a suitable reaction vessel with an organic solvent. Suitable solvents include glycol ethers such as ethylene glycol methyl ether and propylene glycol methyl ether. The mixture is heated to a temperature of about 50° C., the amine and hydroxy acid are added, and the mixture allowed to exotherm to a temperature of about 90 to 100° C.

The mole ratio of the epoxy-containing polymer or oligomer to hydroxy acid to amine is from 0.6 to 5.0:0.05 to 5.5:1, preferably 1.5 to 2.5:1.0 to 2.0:1.

The reaction product may then be thinned with additional organic solvents and/or water preferably containing an acid which can form the carrier medium for the reaction product. Examples of other organic solvents include alcohols with up to about 8 carbon atoms such as methanol, isopropanol, and the like, additional glycol ethers such as the monoalkyl ethers of ethylene glycol, diethylene glycol, or propylene glycol, and the like. Water, containing sulfamic acid, is the preferred ingredient in the carrier medium. When present, the water dispersible organic solvents are typically used in amounts up to about twenty (20) percent, preferably ten (10) percent by volume, based on the total volume of the carrier medium with water being the remaining.

The reaction product is present in the carrier medium of the present invention in an amount of 0.005 % to 30%, preferably 0.5% to 3% based on the total solids weight of the composition.

The weight ratio of the reaction product to Group IIIB or IVB metal or metal compound is from 2.0 to 10.0:1, preferably 3.0 to 5.0:1 based on metal.

Optional materials in the composition include surfactants that function as defoamers or substrate wetting agents. Anionic, cationic, amphoteric, or nonionic surfactants may be used. Compatible mixtures of such materials are also suitable. Surfactants are typically present at levels up to about 1 percent, preferably up to about 0.1 percent by volume, and wetting agents are typically present at levels up to about 2 percent, preferably up to about 0.5 percent by volume, based on the total volume of carrier medium.

The film coverage of the residue of the pretreatment coating composition generally ranges from about 1 to about 1000 milligrams per square meter ($mg/m^2$), and is preferably about 10 to about 400 $mg/m^2$. The thickness of the pretreatment coating can vary, but is generally less than about 1 micrometer, preferably ranges from about 1 to about 500 nanometers, and more preferably is about 10 to about 300 nanometers.

After contact with the compositions of the present invention, the metal substrate may be rinsed with water and coated with any of a number of different types of protective or decorative coatings, including primer coatings applied by electrodeposition and primers and powder coating top coats, which are applied by non-electrophoretic means. Such coatings can be applied directly to the passivated substrates and may be done immediately after treatment or after a drying period at ambient or elevated temperature conditions.

Suitable electrodepositable compositions include any of those known in the art, such as those disclosed in WO 98/07770 and U.S. Pat. Nos. 5,760,107 and 5,820,987 , incorporated herein by reference. Examples of suitable primer compositions applied by non-electrophoretic means are zinc-rich primers such as are disclosed in U.S. Pat. Nos. 4,157,924, 4,346,143 and 5,001,173, incorporated herein by reference, and powder coating compositions such as Enviracron PCT 80130, a polyester TGIC powder coating commercially available from PPG Industries, Inc.

The methods for applying and curing these protective or decorative coatings are conventional and are described in the aforementioned patents.

The invention will be further described by reference to the following examples. Unless otherwise indicated, all parts are by weight.

EXAMPLES

In accordance with the present invention, the following examples illustrate the preparation of aqueous pretreatment compositions containing zirconium compounds and epoxy-based resins, their application to bare and phosphated ferrous, zinc coated, and aluminum substrates, and comparative corrosion testing results. The pH of all pretreatment compositions were measured at ambient temperatures (20–30° C.) using a Digital Ionalyzer Model SA720, commercially available from Orion Research.

Example 1

Preparation of the Preferred Metal Pretreatment Composition

First, an aromatic epoxy-functional material was reacted with dimethylolpropionic acid and diethylamine in a 10:3.5:2.5 ratio. The following materials were used:

| MATERIAL | AMOUNT |
|---|---|
| EPON 880 | 604.4 grams |
| Dimethylolpropionic acid | 149.9 grams |
| Diethanolamine | 85.0 grams |
| Mazon 1651 | 93.3 grams |
| Benzyldimethylamine | 3.5 grams |
| Sulfamic acid | 40.3 grams |
| Deionized water | 1896.9 grams |

A 2000 ml 4-neck, round-bottom flask was equipped with a stirrer, thermocouple, gas inlet tube, condenser and heating mantle. The flask was charged with the EPON 880, (Bisphenol A diglycidyl ether, available from Shell Chemical Company), the dimethylolpropionic acid (available from GEO Specialty Chemicals), the Mazon 1651 (available from BASF Corporation), the diethanolamine, and the benzyldimethylamine catalyst. This mixture was stirred under a nitrogen blanket and slowly heated to initiate an exothermic reaction. After the exotherm had spent itself, the temperature of the reaction mixture was adjusted to 150° C. After about 75 min. at 150° C., the epoxy equivalent was found to be 60,500 on solids and the Gardner-Holdt bubble viscosity of a theoretical 50% solids (Mazon 1651 considered as a solid) solution in 1-methoxy-2-propanol solvent was found to be E/F. 600 gm of product was poured into a stirred solution of 630.8 gm of deionized water (which had been warmed to about 50° C.) and the sulfamic acid. After about 20 min. of stirring, the remaining amount of deionized water was added gradually to yield a dispersion which evidenced 24.5% solids upon heating at 110° C. for one hour in an electric oven with a circulating fan.

A typical laboratory scale preparation of the preferred metal pretreatment composition using the resin portion prepared above contains the following materials:

| MATERIAL | AMOUNT |
|---|---|
| Reaction product prepared above | 4.08 g |
| 25% Fluorozirconic acid | 1.59 g |

The composition was prepared by adding the reaction product to a portion of deionized water with agitation, adding the fluorozirconic acid, and diluting with deionized water to 1 L. The pH was then adjusted with 10% ammonium hydroxide to a final value of 4.50.

Example 2

Panel Preparation for Corrosion Resistance Testing

Bare, untreated cold rolled steel, hot dipped galvanized steel, electrogalvanized steel, and aluminum (6061T6 alloy) substrates used in preparing test panels were purchased from ACT Laboratories, Inc., Hillsdale, Mich. Zinc and iron phosphated panels to which the invention was applied as a post-rinse were prepared by procedures known to those skilled in the art and whose details can be found in representative U.S. Pat. Nos. 5,209,788 or 5,855,695.

For bare, or non-phosphated panels, the following procedure was used:

Stage #1 "CHEMKLEEN 163", an alkaline cleaner available from PPG Industries, Inc. sprayed @ 2% by volume at 60–65° C. for 1–2 minutes.

Stage #2 Tap water immersion rinse 15–30 seconds, ambient temperature.

Stage #3 Immersion in preferred composition listed above, 60 seconds, ambient temperature, pH=4.5

Stage #4 Deionized water immersion rinse, 15–30 seconds, ambient temperature.

Optionally, an immersion in a 2% by volume nitric acid solution for 5–15 seconds followed by a tap water rinse can be done following stage #2 and before stage #3 for ferrous and/or aluminum based substrates only. Following stage #4, an optional drying with warm air can be done before application of the protective or decorative coating.

Panels prepared by the above procedure produced very thin films on the order of 10–30 nm as determined by depth profiling X-ray photoelectron spectroscopy.

To illustrate the breadth of the utility of the invention, the following examples include corrosion results using several different protective or decorative coatings applied over various substrate types that had been pretreated with the invention. In addition, the results from multiple corrosion tests are reported and tabulated. Panels were grit blasted to remove corrosion products and delaminated paint, and were evaluated by measuring the total creepback of the paint from each side of the scribe at two points where paint loss was at the minimum and maximum. Data is reported in the tables as a range in millimeters, unless otherwise noted in the particular example. For the purposes of comparison, iron and zinc phosphate compositions rinsed with deionized water, chrome-containing compositions, and non-chrome compositions representing the prior art are included.

Example 3

Corrosion Testing with a Polyacrylic Enamel Topcoat

All panels were prepared as in Example 2 on cold-rolled steel and were pretreated using the rinse compositions listed in Table 1 as post-rinses over iron phosphate, or directly to cleaned (non-phosphated) metal. All panels were subsequently painted with Duracron 200, a polyacrylic enamel coating commercially available from PPG Industries, Inc. The paint was reduced according to the manufacturer's instructions and spray-applied to a film thickness of 0.8 to 1.2 mils. Panels were scribed with an 'X' and tested in a salt spray cabinet (per ASTM B117 protocol) for 168 hours. Panels were evaluated by measuring the total creepback of the paint from each side of the scribe at two points where paint loss was at the minimum and maximum. Data is reported in the tables as a range in millimeters.

TABLE 1

| | SUBSTRATE (scribe loss in mm) | | | |
|---|---|---|---|---|
| RINSE | B1000[1] | CF 51[2] | Bare (Clean only) | Nitric acid treated[3] |
| Composition of Example 1 | 1–3 | 0–1 | 2–4 | 0–2 |
| Deionized water (COMPARATIVE) | >10 | >10 | >15 | not tested |
| Chemseal 20[4] (COMPARATIVE) | 1–2 | 0–1 | 6–8 | 5–8 |
| Chemseal 77[5] (COMPARATIVE) | 1–2 | 0–1 | 8–9 | 6–8 |
| Fluorozirconic acid[6] | 4–5 | 2–4 | 5–7 | 4–6 |
| Fluorotitanic acid[7] | 4–5 | 3–4 | 7–9 | 5–7 |

TABLE 1-continued

| RINSE | SUBSTRATE (scribe loss in mm) B1000[1] | CF 51[2] | Bare (Clean only) | Nitric acid treated[3] |
|---|---|---|---|---|

[1]Iron phosphate (solution commercially available from ParkerAmchem division of Henkel Corp.; panels purchased already pretreated from ACT Laboratories)
[2]Chemfos 51, a combination cleaner/iron phosphate solution commercially available from PPG Pretreatment and Specialty Products, and used as a 5.12% solution and sprayed at 62–65° C. for 1 min.
[3]Nitric acid immersion step added to sequence in Example 2 and details thereafter.
[4]CS 20, A mixed hexavalent/trivalent chromium post-rinse composition for phosphated substrates, commercially available from PPG Pretreatment and Specialty Products. The post-rinse was used at 208 to 277 ppm hexavalent chromium and a pH of 4.0–4.5.
[5]CS 77, A non-chrome post-rinse composition for phosphated substrates, commercially available from PPG Pretreatment and Specialty Products. Composition and utility described in U.S. Pat. No. 5,855,695.
[6]Obtained from Aldrich Chemical Co., as a 45% solution. Used at 175 ppm Zr and at pH 4.3–4.6.
[7]Obtained from Atotech USA, Inc., Somerset, NJ as a 60% solution. Used at 175 ppm Zr and at pH 4.2–4.6.

The results in Table 1 indicate the composition in Example 1 can dually operate as a phosphate post-rinse or as a treatment for non-phosphated substrates. Its performance as a direct-to-metal treatment eliminates the need to phosphate before painting, closely matching the performance of a conventional iron phosphate with a chrome containing post-rinse on cold rolled steel.

Example 4

Corrosion Testing on Steel and Aluminum Coated with a Powder Based Topcoat

Non-phosphated cold rolled steel (CRS) and aluminum (Al) test panels in this example were pretreated with the composition in Example 1 via the procedure in Example 2. These panels as well as the comparative examples using iron phosphated substrate with either chrome or non-chrome post-rinses were subsequently coated with Enviracron PCT 80130, a polyester TGIC powder coating commercially available from PPG Industries, Inc. The powder was sprayed electrostatically according to the manufacturer's specifications and cured at 370° F. for 15 minutes. Dry film thicknesses were determined gravimetrically and ranged from 1.0–1.5 mils. Panels were scribed with an 'X' and tested in a salt spray cabinet (per ASTM B117) for 500 hours. Results are reported as a range of average scribe loss in millimeters.

TABLE 2

| PRETREATMENT | SUBSTRATE (scribe loss in mm) CRS | Al |
|---|---|---|
| Composition of Example 1 | 2–4 | 0 |
| CF 51 rinsed w/CS 20 (COMPARATIVE) | 3–4 | 0 |
| CF 51 rinsed w/CS 77 (COMPARATIVE) | 2–3 | 0 |
| ALKALINE CLEAN ONLY (COMPARATIVE) | 5–7 | 0 |

Example 5

Comparative Corrosion Testing with a Leaded Electrocoat

Panels tested in this series were prepared as described in Example 2 on cold rolled steel substrates and painted with ED 5000, an automotive quality, leaded electrodepositable composition commercially available from PPG Industries, Inc. The coating was electrodeposited according to the manufacturer's instructions and cured at 340° F. for 30 minutes. The dry film thickness of the cured paint was 0.8–0.9 mils as determined by magnetic (for steel and galvanized steel) or Edy current (for aluminum alloys) measurement using a Fischerscope Multi 650C. After electrocoating, the panels were scribed with an 'X', and tested using the Renault 3C test protocol(D17 1686), an automotive cyclic corrosion test run for 5 cycles (5 weeks). Maximum scribe creeps are reported in millimeters, with a creep greater than 5 mm considered to be a failure. Results are summarized in Table 3 below:

TABLE 3

| RINSE | SUBSTRATE (maximum scribe loss in mm) B1000 | CF 51 | Bare | Nitric acid treated[1] |
|---|---|---|---|---|
| Composition of Example 1 | 1.5 | 1.0 | 4.0 | 1.0 |
| Deionized water (COMPARATIVE) | 3.0 | 4.0 | 11.0 | not tested |
| Chemseal 20 (COMPARATIVE) | 1.0 | 1.5 | 8.0 | not tested |
| Chemseal 77 (COMPARATIVE) | 1.0 | 1.0 | 14.0 | 18.0 |

[1]As described in Example 2

Example 6

Corrosion Testing on Steel, Zinc-Coated Steel and Aluminum Coated with a Lead-free Electrodepositable Composition Cold rolled steel (CRS), electrogalvanized steel (EG), hot-dipped galvanized steel (HDG) and aluminum (Al) test panels in this example were pretreated with the composition in Example 1 via the procedure in Example 2, painted with Enviroprime, an automotive quality lead-free electrodepositable coating commercially available from PPG Industries. The paint was applied per manufacturer's specifications and cured at 340° F. for 20 minutes. Dry film thicknesses were measured as above and on average were 0.8–0.9 mils regardless of substrate Panels were scribed with an 'X' and placed into warm salt water immersion for 5 days. Panels were evaluated by measuring the total creepback of the paint from each side of the scribe at two points where paint loss was at the minimum and maximum. Data is reported in the tables as a range in millimeters.

TABLE 4

| Pretreatment | SUBSTRATE CRS | EG | HDG | Al |
|---|---|---|---|---|
| Composition of Example 1 | 1–2 | 2–4 | 1–2 | 0 |
| CF 51/rinsed w/CS 20 (COMPARATIVE) | 2–4 | 3–5 | 1–3 | 0–1 |
| CF 51/ rinsed w/CS 77 (COMPARATIVE) | 2–4 | 2–5 | 1–3 | 0–1 |
| CF 710[1]/rinsed w/CS 20 (COMPARATIVE) | 0 | 2–3 | 0–1 | 0 |

TABLE 4-continued

| Pretreatment | SUBSTRATE | | | |
|---|---|---|---|---|
| | CRS | EG | HDG | Al |
| Alkaline clean only (COMPARATIVE) | 7–10 | 5–6 | 3–5 | 0–1 |

[1]Chemfos 710, a spray-applied trication (Zn/Mn/Ni) zinc phosphate commercially available from PPG Pretreatment and Specialty Products Warm salt water immersion is a particularly aggressive test used to rapidly screen pretreatments and electrodepositable coating for automotive and industrial applications. The comparative data from the conventional automotive zinc phosphate with a chrome rinse in this test series illustrates the relatively good performance offered by the present invention and may provide an environmentally friendly alternative to conventional pretreatment compositions.

Examples 3–6 above demonstrate the composition of the present invention to be an environmentally friendly treatment which is effective for corrosion inhibition on multiple metallic substrates, while providing good adhesion for various protective and decorative coatings. The composition of the present invention is useful as a non-chrome post-rinse for phosphated substrates and perhaps more importantly, provides effective protection as a direct-to-metal treatment for non-phosphated substrates. Such a composition is a non-hazardous alternative to the conventional phosphating compositions, offering a simpler operating procedure and a reduction in the amount of sludge typically produced with phosphating while maintaining the performance of conventional phosphate coatings with chrome post-rinses.

We claim:

1. A composition for passivating metal substrates, which is substantially free of chromium and which comprises:

a) a Group IIIB or IVB metal or metal compound; and b) from 100 to 5000 ppm of a reaction product of an epoxy group-containing polymer or oligomer with a mixture of a hydroxy functional acid and a dialkanolamine.

2. The composition of claim 1 wherein the Group IIIB or IVB metal compound is a zirconium compound.

3. The composition of claim 2 wherein the zirconium compound is hexafluorozirconic acid.

4. The composition of claim 1 wherein the epoxy group-containing polymer or oligomer is a polyglycidyl ether of a polyhydric phenol.

5. The composition of claim 4 wherein the epoxy group-containing polymer or oligomer is the diglycidyl ether of Bisphenol A.

6. The composition of claim 1 in which the dialkanolamine is diethanolamine.

7. The composition of claim 1 in which the hydroxy functional acid is dimethylolpropionic acid.

8. The composition of claim 1 wherein the epoxy group-containing polymer or oligomer, hydroxy functional acid, and dialkanolamine are reacted in a 0.6 to 5.0:0.05 to 5.5:1 mole ratio.

9. The composition of claim 1 wherein (a) and the reaction product are mixed together in an aqueous carrier medium.

10. The composition of claim 1 wherein component (a) constitutes from 10 to 5000 ppm metal.

11. A composition for passivating metal substrates, which is substantially free of chromium and which is prepared by mixing together:

a) a zirconium compound; and b) a reaction product of a polyglycidyl ether of a polyhydric phenol, dimethylolpropionic acid and a dialkanolamine.

12. The composition of claim 11 in which the polyglycidyl ether of a polyhydric phenol, dimethylolpropionic acid and dialkanolamine are reacted in a 0.6 to 5.0:0.05 to 5.5:1 mole ratio.

13. A process for passivating a metal substrate comprising contacting the substrate with the composition of claim 1.

14. The process of claim 13 in which the metal substrate is untreated.

15. The process of claim 13 in which the metal substrate is phosphated.

16. The process of claim 13 wherein the Group IIIB or IVB metal or metal compound and the reaction product are mixed together in an aqueous carrier medium.

17. The process of claim 16 wherein the metal substrate is contacted with the composition at a temperature of from 60 to 150° F. (15 to 65° C.).

18. The process of claim 16 wherein the metal substrate is contacted with the composition by immersion.

19. The process of claim 13 wherein the Group IIIB or IVB metal compound is a zirconium compound.

20. The process of claim 19 wherein the zirconium compound is hexafluorozirconic acid.

21. The process of claim 16 wherein the component (a) constitutes from 10 to 5000 ppm metal.

22. The process of claim 16 wherein component (b) constitutes from 100 to 5000 ppm.

23. The process of claim 13 wherein the metal substrate is selected from cold rolled steel, steel coated or plated with zinc metal, zinc compounds or zinc alloys, aluminum, aluminum alloys and a multimetal substrate containing two or more metals selected from the group consisting of cold rolled steel, steel coated or plated with zinc metal, zinc compounds or zinc alloys and aluminum.

24. The process of claim 13 in which the metal substrate comprises more than one metal.

25. The process of claim 13 in which the metal substrate comprises a multimetal substrate containing two or more metals selected from the group consisting of cold rolled steel, steel coated or plated with zinc metal and aluminum.

26. The process of claim 13 further comprising the step of:

a) after contacting the metal substrate with the composition, electrodepositing a coating on the substrate.

27. The process of claim 13 further comprising the step of:

a) after contacting the metal substrate with the composition, applying by non-electrophoretic means a primer coating to the substrate.

28. The process of claim 27 in which the primer coating is a zinc-rich primer coating.

29. The process of claim 13 further comprising the step of:

a) after contacting the metal substrate with the composition, applying a powder coating composition to the substrate.

* * * * *